United States Patent [19]

Young

[11] 3,994,402

[45] Nov. 30, 1976

[54] MEANS TO CONNECT COUPLER SHANK TO CUSHION UNIT

[75] Inventor: Terry G. Young, Stafford, Tex.

[73] Assignee: ACF Industries, Incorporated, New York, N.Y.

[22] Filed: June 12, 1975

[21] Appl. No.: 586,331

[52] U.S. Cl. ..... 213/50.5; 213/69

[51] Int. Cl.[2] ..... B61G 9/24

[58] Field of Search ..... 213/50.5, 69, 69 S, 213/67 R, 67 A, 54, 64; 85/5 N, 7; 403/378, 379, 318, 324

[56] References Cited

UNITED STATES PATENTS

| | | | |
|---|---|---|---|
| 1,823,971 | 9/1931 | Erlandson | 403/318 X |
| 3,220,563 | 11/1965 | Baker | 213/67 R X |
| 3,760,954 | 9/1973 | Hershey et al. | 213/69 |
| 3,802,577 | 4/1974 | Niggemeier et al. | 213/69 X |

*Primary Examiner*—Robert B. Reeves
*Assistant Examiner*—John P. Shannon
*Attorney, Agent, or Firm*—Eugene N. Riddle

[57] ABSTRACT

An "E" type coupler for a railway car has a key connecting the coupler shank to an end-of-car cushioning unit. The cushioning unit has a slidable end cap housing assembly receiving the coupler shank and a slot extending through the shank and one side of that housing assembly to receive and mount the coupler key. An inner recess in the other opposed side of the housing assembly recess receives the key in abutting relation to such other side and a retainer on the other side contacts and retains the key in the housing assembly.

4 Claims, 6 Drawing Figures

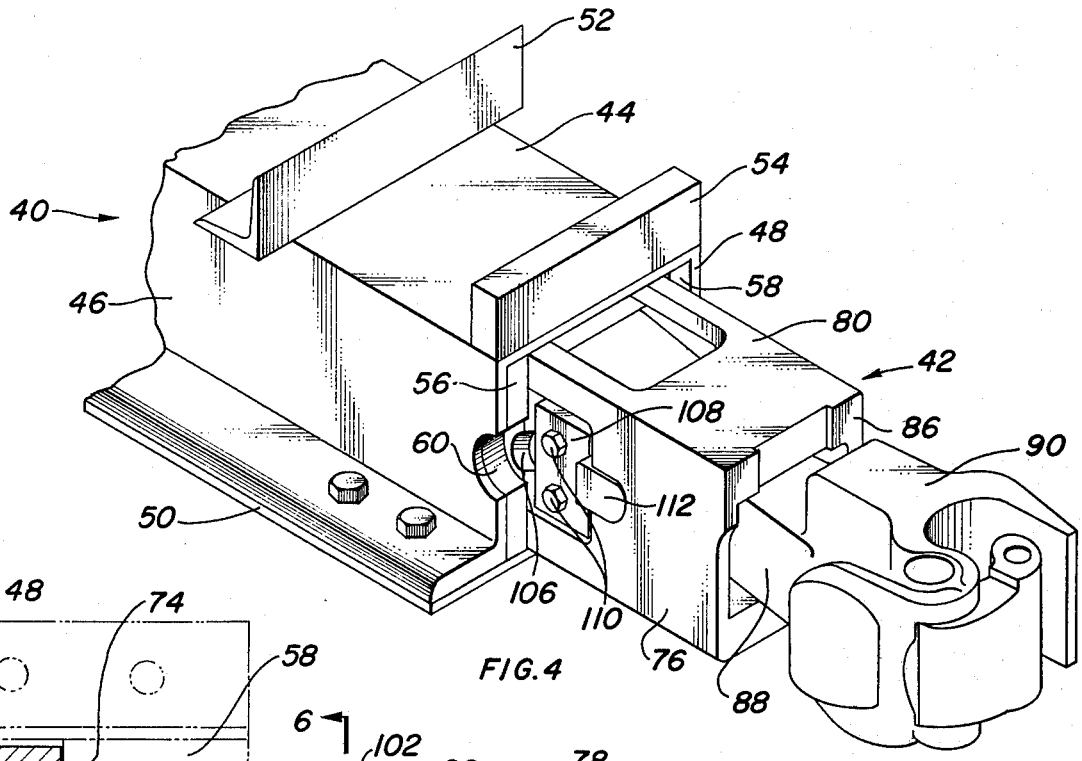
FIG. 4
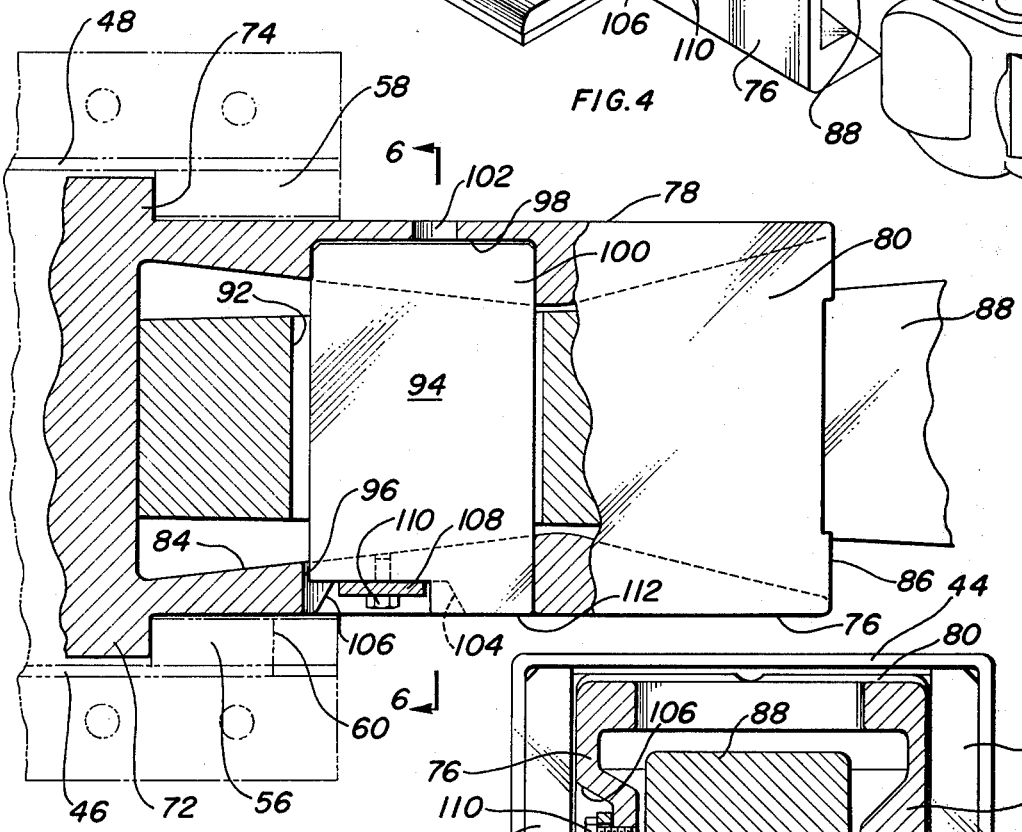
FIG. 5
FIG. 6

MEANS TO CONNECT COUPLER SHANK TO CUSHION UNIT

BACKGROUND OF THE INVENTION

This invention is related to the coupler key mounting for an "E" type coupler for a railway car. More particularly, the invention is related to the coupler key mount in a railway end-of-car cushioning unit for mounting an "E" type coupler.

The best known prior art is shown on FIGS. 1 and 2 of the drawings and labeled as "Prior Art". In FIGS. 1 and 2, a railway car center sill is indicated partially at 10 and receives in its open end an end-of-car cushioning unit generally indicated at 12. Cushioning unit 12 has an open ended housing 18 secured at one end to cyclinder 20 and receiving within its other open end a shank 21 of an E-type coupler 14. Coupler key 16 is received within apertures or slots 22 and 23 in opposed sides of center sill 10. Draft lugs 24 and 26 on opposed sides of housing 18 are adapted to abut fixed draft lugs 28 and 30 secured to opposed sides of center sill 10.

Cushioning unit 12 is installed within center sill 10 with draft lugs 24 and 26 in abutting relation to draft lugs 28 and 30. Then with coupler shank 21 within housing 18, key 16 is positioned within an aperture 32 through one side of sill 10 and thence through slots 22 and 23 and a suitable aligned slot in coupler shank 21. After coupler key 16 is positioned, a retainer 34 is bolted to center sill 10 and secured to sill stiffener 36. In this position, coupler key 16 can move laterally within housing 18 and shank 21 since it is not rigidly fastened. Key 16 does, however, move longitudinally with housing 18 and shank 21 relative to center sill 10 upon the exertion of impact forces against coupler 14.

The main deficiency in the prior art as illustrated in FIGS. 1 and 2 is that coupler key 16 sometimes is moved laterally from side to side and coupler key 16 can be dislodged from its normal position to a position where one end of the key substantially extends from one side of open ended housing 18. This particular position of coupler key 16 can and has in practice caused open ended housing 18 to be jammed against one side of center sill 10 with the key extending from its opposite side. This jamming prevents side to side movement of open ended housing 18 and additionally prevents its retraction into center sill 10 during buff loading. In order to prevent this jamming, a guide block 38 is welded to retainer 34 and another guide block 39 is welded to the opposed side of the center sill as shown. These blocks 38 and 39 will prevent coupler key 16 from being substantially displaced from open ended housing 18 when the cushioning unit is in the fully extended position. Another disadvantage to this type of mounting structure is that the two pairs of front draft lugs must be welded in the center sill during the car construction and positioned to within close tolerances for the cushioning unit to operate properly. In the normal construction of a railway car, the center sill is installed long before the cushioning unit 12 has to be installed. When the cushioning unit is to be installed the front draft lugs must be welded in place in their proper position inside the sill before the cushioning unit can be installed. This operation is time consuming and tedious in order to position the lugs so that they have the proper spacing relative to the end of the sill and so they have the proper spacing to allow the coupler key 16 to move forward and rearward. It is to be understood that the structure shown and described herein as prior art is not the only structure known prior to the herein disclosed invention. However, it is believed to be the most pertinent prior art.

SUMMARY OF THE INVENTION

In an embodiment the improved coupler key mount structure of this invention is used in a railroad end-of-car cushioning unit which is mounted within the center sill of the railroad car. The structure includes an elongated slot through one side of an open ended housing that mounts the shank of the railroad coupler and an inner recess on the opposed side of the open ended housing in opposed relation to the slot so that the coupler key can pass through the slot with one end resting in the inner recess. An exterior recess in the open ended housing adjacent to the slot is provided for mounting a retainer member to contact and retain the coupler key in place in the open ended housing.

One object of this invention is to provide a coupler key mounting structure which overcomes the disadvantages of the aforementioned devices.

Still, one other object of this invention is to provide an improved coupler key mounting structure for the coupler key in a railroad end-of-car cushioning device wherein the coupler key is retained within an open ended housing which mounts the shank of the coupler in such a manner that the key cannot interfere with sliding motion of the open ended housing in the center sill.

Still, another object of this invention is to provide a simplified end-of-car cushioning unit wherein the open ended housing which mounts the shank of the coupler is constructed so that no precision fabricating is required for installation of the cushioning unit.

Various other objects, advantages, and features of the invention will become apparent to those skilled in the art from the following discussion, taken in conjunction with the accompanying drawings, in which:

DESCRIPTION OF THE DRAWINGS

FIG. 4 is a perspective view of a railroad car center sill having an end-of-car cushioning unit mounted therein wherein the cushioning unit employs the novel invention disclosed herein;

FIG. 5 is a partially cut-away view of a railroad car center sill having the center portion thereof cut away exposing the rear of the coupler shank and coupler key in its mounted relation in the open ended housing. The center sill is shown in dashed lines; and FIG. 6 is a cross-sectional view of the cushioning unit and center sill taken on line 6—6 of FIG. 5.

Figure 1:
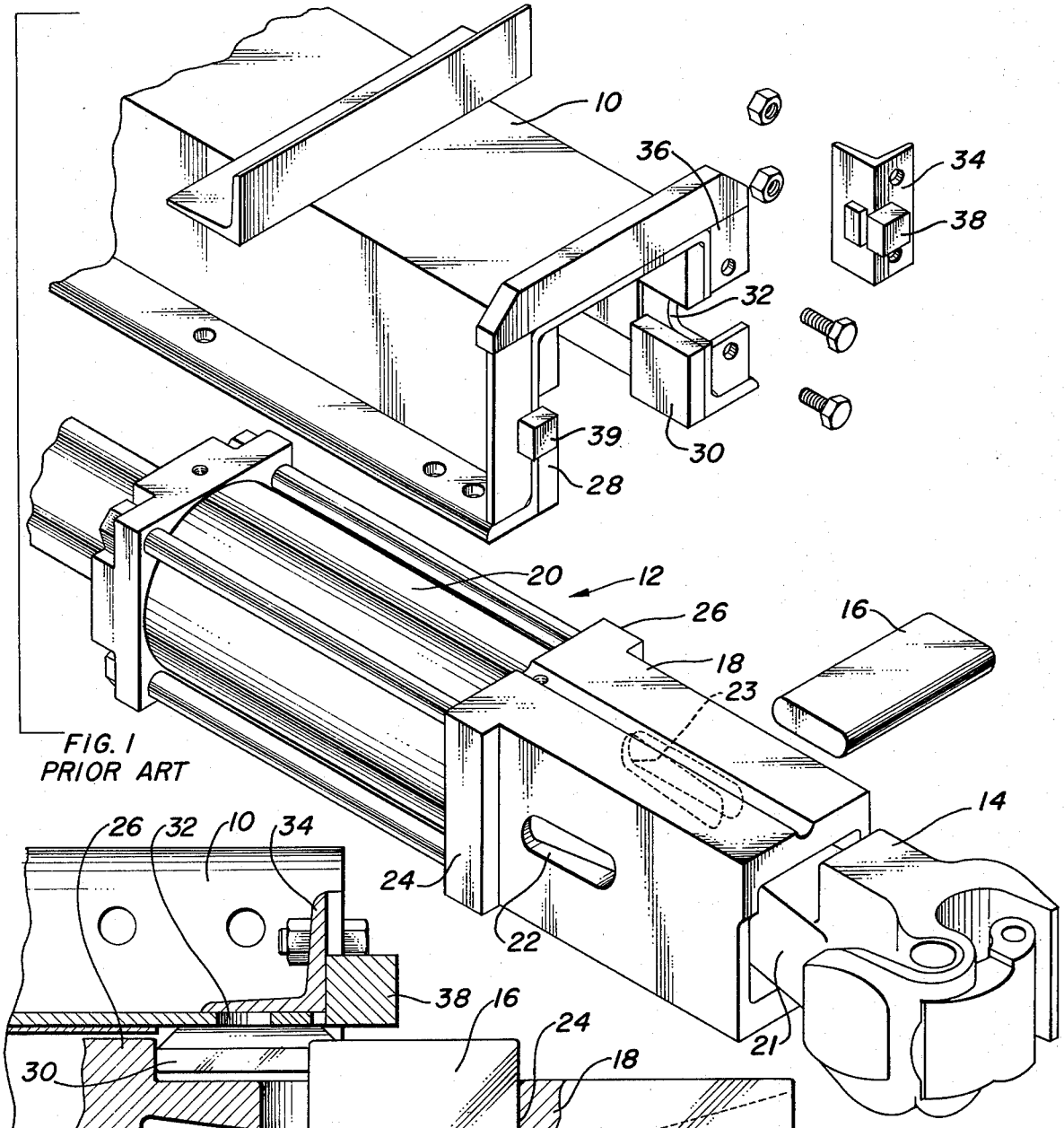
FIG. 1 PRIOR ART
FIG. 1 is in exploded perspective view of the center sill portion of a railcar and and end-of-car cushioning unit illustrating a typical prior art device.
Figure 2:
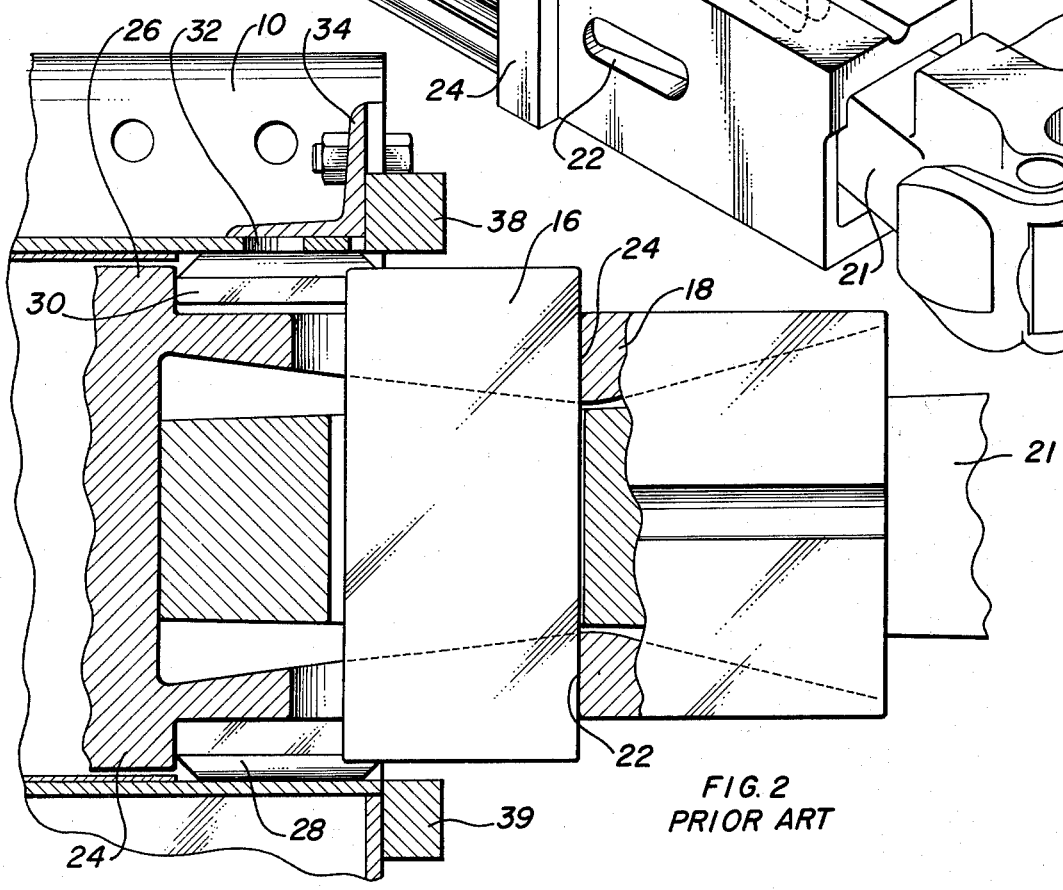
FIG. 2 PRIOR ART
FIG. 2 is a partially cut-away view of the end of the center sill of a railroad car and the end-of-car cushioning device shown in FIG. 1.

The following is a discussion and description of preferred specific embodiments of the novel coupler key mounting structure of this invention, such being made with reference to the drawings, where upon the same referenced numerals are used to indicate the same or similar parts and/or structure. It is to be understood that such discussion and description is not to unduly limit the scope of the invention.

DETAILED DESCRIPTION

Referring to the drawings in detail and in particular to FIG. 4 which shows a railroad car center sill and supporting structure, indicated generally at 40, along with an end-of-car cushioning, indicated generally at 42, mounted in the center sill and extending therefrom. This view illustrates the normal mounted configuration for an end-of-car cushioning device in a railroad car. The center sill structure includes a top 44 and opposed sides 46 and 48 which form a hollow elongated rectangular member. A bottom cover plate 50 is secured to flanges on lower portions of sill sides 46 and 48. The center sill is supported in part by the railway car's end sill 52 as shown and it is also supported at other structures not shown through the length of the car. A striker 54 is rigidly mounted on the end of the sill's top 44. A pair of front draft lugs 56 and 58 are mounted inside sill sides 46 and 48 respectively at the end as shown. On the end of side 46, a notch 60 is formed through the side of the sill and through draft lug 56, as shown. End-of-car cushioning unit 42 is mounted inside center sill 40 with an end cap housing assembly thereof slidably mounted in the end portion of the center sill and extending therefrom as shown in FIG. 4.

Figure 3:
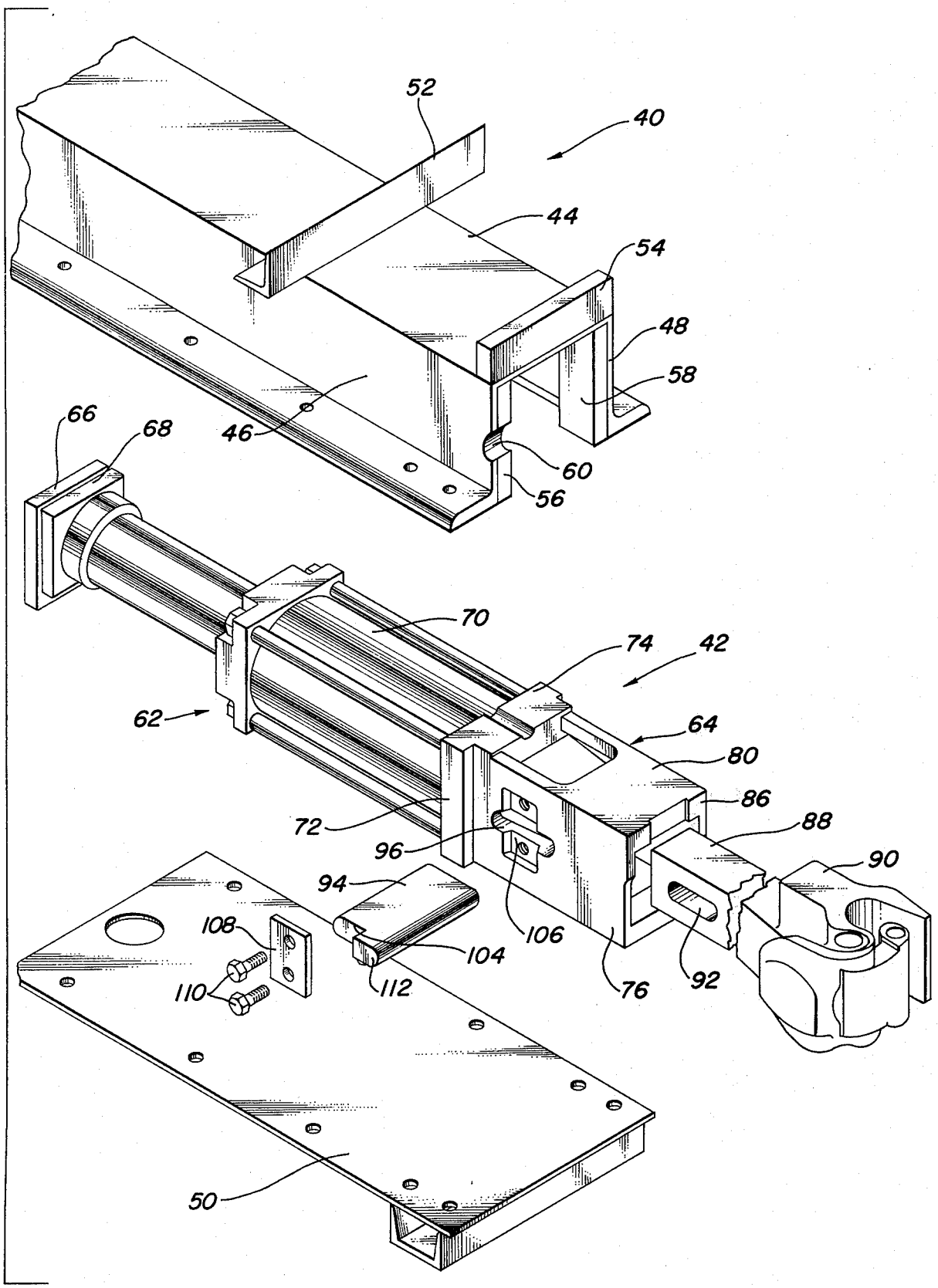
FIG. 3 is an exploded perspective view of the center sill of a railroad car and an end-of-car cushioning unit employing the invention disclosed herein.

FIG. 3 shows the structure of the end-of-car cushioning unit 42 in an exploded view along with the structure of the railroad car center sill 40. The end-of-car cushioning unit has a hydraulic telescopic cushioning assembly 62 which has an end cap housing assembly 64 mounted on one end thereof. The end cap housing assembly provides the mounting structure for the coupler. The hydraulic cushioning assembly 62, when mounted, is enclosed within the center sill. The hydraulic cushioning assembly 62 has an alignment plate 66 on its inner end which contacts cylinder end cap 68 that is secured to the hydraulic cushioning apparatus and thereby transmits forces to the center sill through the alignment plate 66. In use alignment plate 66 rests on an abutment (not shown) inside center sill 40. Hydraulic cushioning assembly 62 has an outer cylinder 70 with the end cap housing assembly secured thereto and forming the end cap of this cylinder. Draft lugs 72 and 74 are provided on opposed sides of the innermost end of end cap housing assembly 64. Draft lugs 72 and 74 in use contact the front draft lugs 56 and 58 respectively in the center sill to limit the extending movement of end-of-car cushioning unit 42. End cap housing assembly 64 includes an open ended housing which is integrally formed with the portion of the housing assembly which is the end cap of cylinder 70. The open ended housing has opposed sides 76 and 78, a top 80 and a bottom 82 which extend from the end cap portion and the draft lugs 72 and 74 to the opposite end of the housing assembly. The open ended housing has an internal opening or aperture 84 which opens at the housing's outer end 86. This internal aperture 84 is sized and shaped as shown in FIG. 5 to accept the coupler shank 88. The coupler has a standard E-type coupler well known in the railroad art having a head 90 integrally formed with shank 88 and having a slot 92 through the shank in the end portion opposite to head 90. Coupler key 94 connects end cap housing assembly 64 and coupler shank 88.

End cap housing assembly 64 has a slot 96 through side wall 76 to receive and pass coupler key 94. Coupler key 94 and slot 96 are elongated and generally oval in shape as shown in the drawings. The open ended housing side wall 78 has a recess 98 in the inside thereof in opposed relation to slot 96 to receive the inner end portion 100 of coupler key 94. An aperture 102 is provided through side wall 78 at a mid-portion of recess 98 to provide an opening for an insertion of a tool to be used in dislodging coupler key 94 from the open ended housing. Recess 98 is preferably generally elongated in shape to conform to the exterior shape of coupler key 94. The outer end portion of coupler key 94 is provided with a notch 104 extending from a mid-portion thereof to one end edge thereof as shown. Housing side wall 76 has a recess 106 in the exterior thereof at notch 94 to receive and mount a retainer 108. Retainer 108 is an elongated member having holes through its opposed end portions to receive and pass a fastener comprising bolts 110 which are threadedly engaged in side wall 76. Recess 106 is substantially deep enough to place retainer 108 and bolts 110 at a point so the outer end of the fastener's head does not extend beyond the exterior surface of side wall 76 as shown in FIGS. 5 and 6. Coupler key 94 is sized so that its outer end 112 is essentially flush with the exterior surface of side wall 76.

In assembly of the end-of-car cushioning unit 42, the hydraulic cushioning assembly 62 is assembled and secured to housing in end cap assembly 64 prior to installation of the coupler. In installing the coupler, shank 88 is inserted into the end opening and slot 92 is aligned with slot 96 so coupler key 94 can be slid through slots 96 and 92 to its final resting position as shown in FIGS. 5 and 6. In the normal mounted position, the inner end 100 of coupler key 94 rests in recess 98. Once coupler key 94 is in place then retainer 108 is positioned in recess 106 and secured by bolts 110, as shown.

It is to be noted that an important feature of this invention is that coupler key 94 is positively retained in slot 96 and recess 98 in the open ended housing and through coupler shank 88 in comparison to the prior art devices wherein the coupler key is not positively retained in the housing and coupler shank. Once coupler key 94 is installed, the cushioning unit 42 complete with the coupler is ready for installation in the center sill of a railroad car. In installing this unit in a railroad car it is simply lifted from below into place in center sill 40, after front draft lugs 56 and 58 have been welded in place in the sill. Once the unit is in place then bottom cover plate 50 can be bolted or otherwise secured to center sill 40.

In disassembly of the end cap housing assembly the coupler can be easily removed. This is accomplished by removing retainer 108 then positioning end cap housing assembly in the fully extended position so the rearmost portion of slot 96 is at least ahead of the rearmost portion of notch 60 as shown in FIG. 5. With the assembly positioned in this manner, a suitable tool such as a rod, punch or the like, can be inserted into aperture 102 and used to dislodge and drive out coupler key 94 from its mounted position in open ended housing and the coupler shank 88.

In the use and operation of the coupler key mounting of this invention, it is seen that such provides a great improvement over the prior art by providing a positive mounting structure for the coupler key in an end-of-car cushioning unit for mounting an E-type coupler. This invention positively retains the coupler key in place in the coupler mounting portion of the cushioning unit and it is unaffected by side to side motion or translating motion of the cushioning unit or the coupler. Because the coupler key is positively retained in place in the structure under normal conditions, it will not jam the cushioning unit or in any way impede motion or operation of the cushioning unit components or the coupler.

What is claimed is:

1. In a railroad car having a center sill, an end-of-the car cushioning unit within the center sill including a cylinder and an open ended housing of a rectangular cross section secured at one end to the cylinder, a coupler received within the open ended housing, and a horizontally extending key of a generally rectangular uniform cross section connecting said coupler shank and said housing, an improvement comprising:

a. an elongated slot through one side of said open ended housing to receive and pass said key, b. an inner recess in the other opposed side of said open ended housing in opposed relation to said slot to receive an end portion of said key in abutting relation to said other side, said inner recess having an elongated shape corresponding to the generally rectangular cross section of said key, c. an exterior recess in said one side adjacent said elongated slot, d. a retainer member rigidly mounted in said exterior recess to contact and retain said key in place in said open ended housing and said shank, and e. a fastener securing the retainer member to the housing within said exterior recess, f. said exterior recess being at least deep enough to enclose both said retainer member and said fastener such that said retainer member and said fastener do not protrude past the exterior surface of that side of said open ended housing.

2. The improvement of claim 1, wherein:

said key has a notch receiving said retainer member and extending from a center portion of said key to an end edge portion thereof at one end of the generally rectangular cross section thereof.

3. In a railway end-of-car cushioning unit for mounting within the center sill of a railway car and having a cylinder, an open ended housing of a rectangular cross section secured at one end to the cylinder, a coupler shank received within the open ended housing, and a horizontally extending key of a generally rectangular uniform cross section connecting said coupler shank and said housing, an improvement comprising:

a. an elongated slot through one side of said open ended housing to receive and pass said key, b. an inner recess in the other opposed side of said open ended housing in opposed relation to said slot to receive an end portion of said elongate key in abutting relation to said other side, c. an exterior recess in said one side adjacent said elongated slot, d. a retainer member within said exterior recess contacting said key in place in said housing and said shank, and e. fastener means to secure said retainer member to said housing within said recess, f. said inner recess having a cross-sectional shape corresponding to the cross-sectional shape of said key, g. said exterior recess being at least deep enough to enclose said retainer member such that it does not protrude past the exterior surface of the adjacent side of said open ended housing.

4. The improvement of claim 3 wherein:

said elongate key has a notch in an outer portion thereof to receive said retainer member, said notch extending from a center portion of said key to an edge portion thereof.

* * * * *